US005474122A

United States Patent [19]

Pierce

[11] Patent Number: 5,474,122

[45] Date of Patent: Dec. 12, 1995

[54] FACADE PLATE, ASSEMBLY AND HEAT EXCHANGER

[76] Inventor: David B. Pierce, 344 Sutton Road, Walsall West Midlands WS5 3BB, United Kingdom

[21] Appl. No.: 211,515

[22] PCT Filed: Aug. 5, 1993

[86] PCT No.: PCT/GB93/01658

§ 371 Date: Apr. 4, 1994

§ 102(e) Date: Apr. 4, 1994

[87] PCT Pub. No.: WO94/03767

PCT Pub. Date: Feb. 17, 1994

[30] Foreign Application Priority Data

Aug. 5, 1992 [GB] United Kingdom ..... 9216644

[51] Int. Cl.[6] ..... F28F 19/00

[52] U.S. Cl. ..... 165/134.1; 165/158

[58] Field of Search ..... 165/134.1, 158, 165/173

[56] References Cited

U.S. PATENT DOCUMENTS

| | | | |
|---|---|---|---|
| 2,143,477 | 1/1939 | Dillon et al. | 165/134.1 X |
| 2,272,863 | 2/1942 | Young . | |
| 3,707,186 | 12/1972 | Zorilla et al. | 165/134.1 |
| 4,254,819 | 3/1981 | Worrell . | |
| 5,133,299 | 7/1992 | Rogan . | |

FOREIGN PATENT DOCUMENTS

| | | |
|---|---|---|
| 415370 | 6/1933 | United Kingdom . |
| 777791 | 6/1957 | United Kingdom . |
| 790704 | 2/1958 | United Kingdom . |
| 1212526 | 11/1970 | United Kingdom . |
| 1236159 | 6/1971 | United Kingdom . |
| 1259111 | 1/1972 | United Kingdom . |
| 1568692 | 6/1980 | United Kingdom . |
| 1601189 | 10/1981 | United Kingdom . |
| 1604180 | 12/1981 | United Kingdom . |
| 2183814 | 6/1987 | United Kingdom . |
| 2234807 | 2/1991 | United Kingdom . |

*Primary Examiner*—John C. Fox
*Attorney, Agent, or Firm*—John W. Bunch

[57] ABSTRACT

The invention relates to a facade plate, assembly and heat exchanger, and relates in particular to a facade plate for securement to a tube plate of a heat exchanger, and to an assembled heat exchanger.

In order to avoid, or reduce the frequency of, replacement of the tubes and tube plates of a heat exchanger, damaged as by erosion and corrosion, we disclose a facade plate for securement to at least a part of a heat exchanger tube plate, said facade plate having apertures conforming to the openings in the said part of the tube plate. We also disclose a facade assembly and fitted heat exchanger, and a method of fitting the facade plate.

9 Claims, 2 Drawing Sheets

FACADE PLATE, ASSEMBLY AND HEAT EXCHANGER

FIELD OF THE INVENTION

This invention relates to a facade plate, assembly, and heat exchanger, and relates in particular to a facade plate for securement to a tube plate of a heat exchanger, and to an assembled heat exchanger.

1. Background of the Invention

Often it is necessary to cool a working fluid, and it is known for this purpose to use a heat exchanger. Whilst heat exchangers can be of different sizes, the invention is likely to find its greatest utility for the larger sizes of heat exchanger such as those used in power generation plants, land and marine; such plants use a relatively large volume flow and/or speed flow of a liquid coolant.

Heat exchangers usually comprise one or more metallic tubes (typically between 100 and 9000 tubes) suspended between two tube plates, though it has been proposed to use U-shaped tubes with each tube connected at opposite ends to a single tube plate. The coolant flows through the tubes, whilst the working fluid passes around and between these tubes and so gives up latent heat (by way of the tubes) to the coolant flowing within the tubes. Each tube may carry external fins (mechanically coupled to or integral with the respective tube) to increase the available surface area for heat transfer, but often the heat exchanger designer will prefer to use the available space to fit a greater number (array) of unfinned tubes, despite the probable cost increase, particularly if the expected operating conditions increase the liklihood of individual tube failure.

Since the working fluid is typically at a higher pressure than that of the coolant, tube failure will result in leakage of the working fluid into the coolant. It is usually uneconomic to treat the coolant to recover the working fluid, and so until the respective tube (when identified) can be replaced it is traditionally taken out of service (with a reduction in heat exchanger capacity). In the interim, escaping working fluid (e.g. oil at 14 kg/sq.cm) may have been discharged with used coolant (e.g. sea water at 2 kg/sq.cm), leading to possible environmental complaints as well as increased heat exchanger operating costs.

Recognised heat exchanger problems are the thinning of a tube wall, particularly adjacent the tube ends, and the pitting or pock-marking of the tube plate(s) around a tube connection position. These problems frequently arise within the tube, or coolant system, in that the coolant can "attack" both at the ends of a tube ("tube" erosion and/or corrosion), and at the tube plate area surrounding the tube ends ("tube to tube plate" erosion and/or corrosion).

Erosion is a common problem in heat exchangers, usually caused by the velocity of flow of the coolant, especially adjacent the ends of the tube, and over the first few centimeters inside of the tube where the fluid flow may be turbulent. Corrosion can be caused by chemical constituents in the coolant, especially noted for example when the coolant is sea water, used in a heat exchanger for a ship or for a power station located adjacent a tidal estuary.

Thus, these effects singly or together can cause the "as new" tube and tube plate of FIG. 2 to degenerate to the condition of FIG. 3, leading to tube degeneration or failure and leakage of the working fluid into the coolant.

In addition to the erosion shown in FIG. 3, and particularly if the coolant is sea water, there is often localised pitting of the tube plate around the tube end, caused particularly by chemical attack.

2. Statement of the Prior Art

Upon the discovery of tube degeneration, it is known to replace the heat exchanger.

It is also known, and more usual, for a heat exchanger engineer to overhaul the heat exchanger i.e. to re-fit the heat exchanger with new tube plates and tubes. In a modification, only the more seriously damaged of the tubes may be replaced, or these may be taken temporarily out of service as by the use of a "tube plug".

It is also known for the engineer to refurbish a tube, to keep it in service, by fitting a tubular insert into some or all of the heat exchanger tubes. Tubular inserts typically comprise a tubular section of up to 10 cm in length and with an outer diameter slightly smaller than the internal diameter of the heat exchanger tube, and with an outwardly extending flange at one end.

The tubular section of the insert is intended to protect the first few centimeters of the inside of the heat exchanger tube, whilst the flange covers and so is intended to help protect the area of the tube plate surrounding the end of the tube, as against pitting. The tubular insert is secured in position as by an applied adhesive, or by the use of an expanding tool to cold-work (stretch) the wall of the (metallic) tubular insert, so increasing its outer diameter by up to 15%, into mechanical adhesion with the inner surface of the tube.

DISCLOSURE OF THE INVENTION

In order to reduce or overcome the erosion and/or corrosion problems as described, and so as to inhibit leakage of working fluid into the coolant, we now propose an alternative solution to those outlined above, seeking to prevent or delay the onset of the problems, as well as to permit their easier solution when identified.

We disclose a facade plate for securement to at least a part of a heat exchanger tube plate, said facade plate having apertures conforming to the openings in the said part of the tube plate. Preferably the facade plate is interchangeable with another of the same design, so that if in use it is affected by erosion and/or corrosion (as is "intended" i.e. in preference to the tube plate and/or tubes being affected) the facade plate can be quickly changed, typically without need to replace either the tube plate or tubes.

We also disclose a heat exchanger which includes a tube plate with preformed openings extending between a first tube plate face and a second tube plate face, a tube connected to each said opening of the tube plate and projecting from said second tube plate face and a facade plate as herein described, the facade plate having apertures corresponding in relative position to at least some of the tube plate openings, and holding means to secure the facade plate to the tube plate first face with said apertures aligned with said openings. Conveniently, said holding means includes at least one peripheral tube plate to header bolt; conveniently also, tubular inserts pass through each of the said apertures and into the corresponding tube.

Preferably, said holding means also includes holding members extending from the facade plate into selected tubes, the said selected tubes will be disposed nearer the axis of the tube plate than its periphery i.e at up to the half-radius of the tube plate, but not beyond, so that the facade plate, and in particular its central portion, is held in tight mating engagement with the tube plate, the tubular inserts in this case passing through the remaining apertures into the corresponding remaining tubes. The use of holding members can be an important feature, since a thin facade plate (desirable for ease of installation and minimum cost) could tend to flex or bow—(a) permitting coolant to settle between the facade plate and tube plate (with possible corrosion) and (b) causing potential damage to any baffle plates located within a header.

Tight mating at the facade plate centre can be achieved by the use of holding members as above described, or by the use of a thicker, substantially rigid, facade plate. However, it has been found that the fitting of tubular inserts, desirable in itself to inhibit erosion, assists in retaining the facade plate tight against the tube plate.

In addition, we disclose a method of mounting a facade plate to a heat exchanger tube plate including the steps of (a) aligning the apertures of the facade plate with openings in the tube plate; (b) passing tubular inserts through each aperture and into the corresponding tube; (c) securing the tubular insert in position; and (d) fitting the header to the heat exchanger to sandwich the facade plate between the header and the tube plate.

Preferably, two additional steps are included between steps (a) and (b), i.e. (a1) inserting at least one holding member through a facade plate aperture; (a2) securing the facade plate to the tube plate with the holding member(s).

As above mentioned, althouth the facade plate may be relatively thin compared to the tube plate (i.e. in the direction between the first and second tube plate surfaces), and is thus able to conform to the tube plate when so required, preferably the facade plate is substantially non-flexible; both the tube plate and facade plate preferably have a flat (machined) mating face, with a sealing means located therebetween, perpahs an annular sealing ring located in a recess e.g. in the facade plate so as to be replaceable therewith.

SHORT DESCRIPTION OF THE DRAWINGS

The invention will be further described, by way of example, with reference to the accompanying drawings, in which.

DESCRIPTION OF EXEMPLARY EMBODIMENTS

Figure 1:
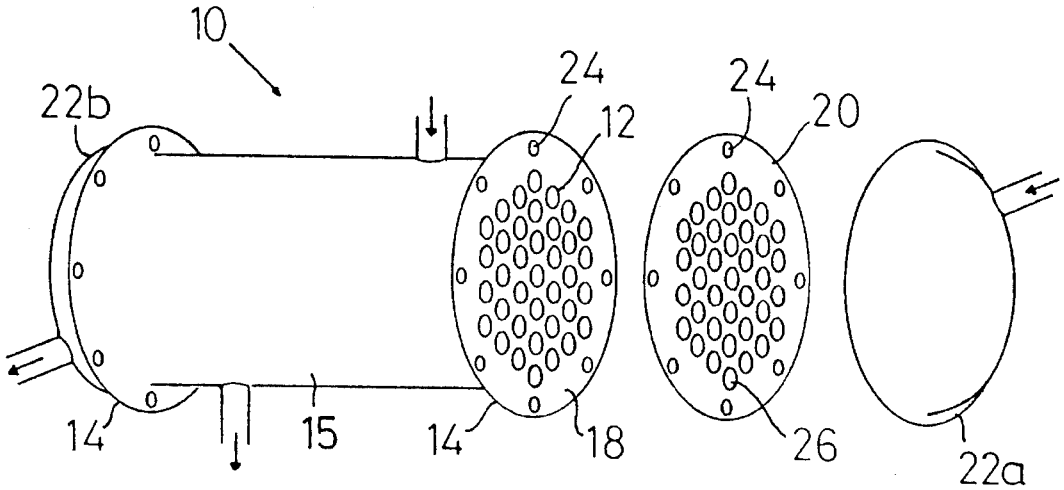
FIG. 1 is a partially exploded view of a heat exchanger with a facade plate according to the invention.

In the drawings, FIG. 1 shows a typical heat exchanger 10, with an array of tubes 12 located between a pair of tube plates 14 and located in a casing 15. The tubes 12 provide openings 17 in the tube plates 14. The tubes 12 project from the second surface 16 (FIG. 2) of each respective tube plate. In this embodiment, coolant is supplied through header **22*a* and exits through header 22*b*; the headers 22*a*,22*b* in an alternative embodiment can have one or more baffle plates, and in another embodiment the tubes are U-shaped and with only a single header, in each case so that the coolant returns to header 22*a*** before passing out from the header to exhaust.

Figure 2:
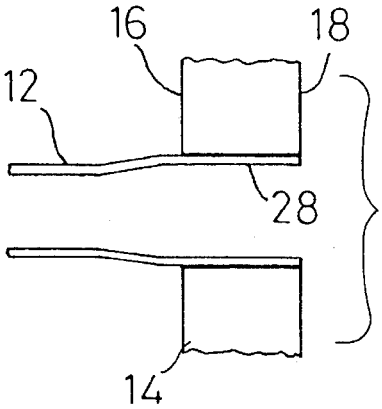
FIG. 2 is a partial view of a single heat exchanger tube, and tube plate, in the "as new" condition.

FIG. 2 shows part of a single heat exchanger tube 12 mounted in tube plate 14. The tube is manufactured with an outer diameter slightly less that the diameter of the holes of the tube plate (the difference between the diameters is exaggerated in the drawings), and so after being slid into position in the tube plate, an expander tool (not shown) is used to expand the wall of tube 12 at the end 28, to secure the tube 12 to the tube plate 14 and to form a fluid tight seal therebetween.

Figure 3:
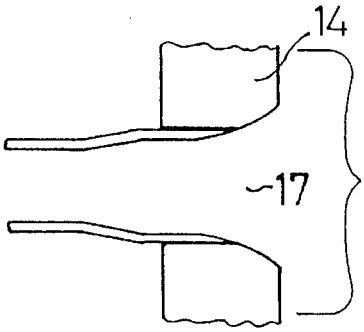
FIG. 3 is a view as FIG. 2 but in an eroded condition.

In use, the rapid and turbulent flow of the coolant fluid adjacent, and within, the end 28 of the tube 12, can cause erosion of the tube and of the tube plate. As explained above, this erosion may be combined with corrosion caused by constituents of, or contaminants in, the coolant. The tube, and tube plate, can therefore degenerate in time into a condition such as that illustrated in FIG. 3, increasing the likelihood of either the fluid to be cooled, or of the coolant, passing between the tube and the tube plate, so (a) contaminating, or (b) causing leakage of, the fluid to be cooled. It will be understood that whilst erosion as by turbulence is greatest within the tubes 12 at the (entrance) end where the coolant enters the tubes, the (exit) end at which the fluid discharges can also become eroded.

The facade plate 20 is, in use, pressed against the first surface 18 of the tube plate 14 and so is sandwiched between the tube plate 14 and the header **22*a*. In a preferred embodiment a second facade plate is pressed against the opposed (outer) surface of the other tube plate and so is sandwiched between that opposed surface and the header 22*b***.

The facade plate 20 is secured at its outer periphery by bolts (not shown) passing through holes 24 in the tube plate 14 and facade 20, and into header **22*a***.

The facade plate 20 has pre-formed apertures 26, the apertures 26 being of a number and in position to correspond with openings in the tube plate 14 and thus with the tubes 12 in the tube plate 14. As better seen in FIG. 4, the size of apertures 26 is chosen to be slightly larger than the inner diameter of the expanded ends 28 of the tubes 12, though in an alternative embodiment the diameters may be identical. In this embodiment, additional securement is provided for the facade plate 20 by holding members 30; the holding members are in the form of tube plugs, with a central spindle 32 (shown in dotted outline), annular locking member 34, frusto-conical member 36, resilient "O-rings" 38, annular spacers 40, and annular tube abutment 42, generally of top-hat shape. The spindle 32 has an enlarged head 44 at one end, and at the other end has a screw thread (not shown) which mates with a screw thread in the annular locking member 34. The enlarged head 44 mates with a seat (not shown) in the annular tube abutment 42, so that the movement of the spindle in the right to left direction of the drawing is resisted by the annular tube abutment. The member 36, O-rings 38, annular spacers 40 and tube abutment 42 are all free to rotate about the spindle. The head 44 of the spindle is recessed (not shown) to receive an "Allen" key, whereby the spindle 32 can be rotated relative to the annular locking member 34. In use, the tube plug 30 is inserted into the tube 12, whereupon the central spindle 32 is rotated relative to the annular locking member 34. The mating screw threads on the spindle and within the annular locking member cause the annular locking member to move longitudinally along the spindle i.e in the right and left directions in the figure, causing the fingers 46 of the locking member 34 to ride over the frusto-conical member 36. In "tightening" the tube plug 30, the fingers 46 are caused to spread apart, bringing their ends into contact with the inside surface of the tube 12, forming a gripping contact therebetween, and in addition, the O-rings 38 are compressed; continued rotation of the spindle causes the facade plate 20 to be pulled towards the tube plate 14.

Thus the tube plugs 30 secure or help secure the facade plate 20 to the tube plate 14, and are positioned in apertures 26 chosen to provide the required securement, and to prevent the facade plate from becoming distorted in use. Depending upon the size of the heat exchanger, and the number of tubes 12, it is possible that one in every hundred of apertures 26 will be required to secure the facade plate 20 to the tube plate 14, so the tube plugs 30 will occupy one per cent of the available heat exchanger tubes. However, as described above, the use of a thicker and more rigid facade plate held by bolts may eliminate the need tube plugs 30, if provided solely as holding members.

Figure 4:
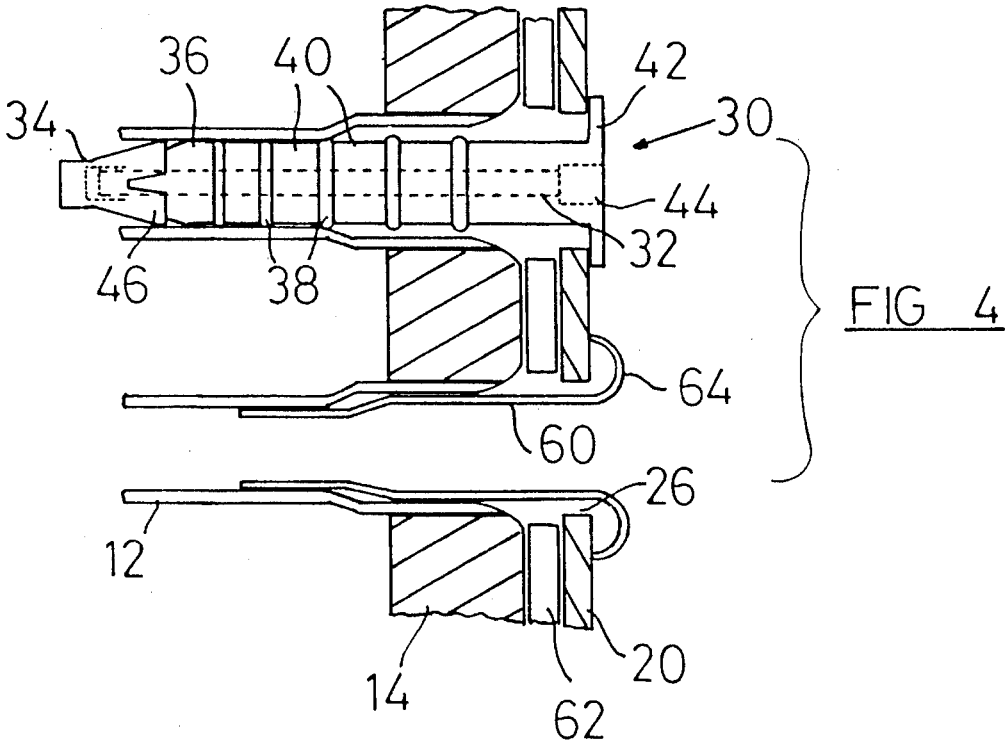
FIG. 4 is a part-sectional view of the tube plate and facade plate of FIG. 1.

FIG. 4 also shows a tubular insert 60 as passed through each aperture 26 not occupied by a tube plug 30. The tubular insert 60 is required to prevent or reduce the likelihood of the coolant fluid coming into "fast-flow" contact with the ends 28 of the heat exchanger tubes 12, and the area of the facade plate surrounding the apertures 26.

In the embodiment shown, the tubular insert 60 is manufactured from annealed tube, usually of cupro-nickel, Royal Naval brass (RNB), or aluminium brass.

Sealing means 62 is also provided, which in this embodiment is a perforated sheet of rubberised material, but in an alternative embodiment may be a silicone sealant applied to one face of the facade plate 14 during its manufacture. In use, the sealing means 62 should act to prevent any coolant that encroaches between the facade plate 20 and the tube plate 14 from contacting all but a small area of the region between the plates. Usefully sealing sheet 62 is affixed to facade plate 20.

In an alternative (but less preferred) embodiment, the sealing means may be a ring of flexible material located only adjacent the outer periphery of the facade plate, in an annular recess sized to permit the sealing means to be compressed for substantially full face-to face-contact between the facade plate and the tube plate. Whilst in this embodiment leaked coolant may perhaps pass between the facade plate and tube plate to adjacent apertures or openings, some operators may be satisfied provided that the coolant is prevented from escaping from the heat exchanger.

In use, the facade plate is placed alongside the tube plate, and the apertures 26 are aligned with the heat exchanger tubes 12; the required number (if any) of tube plugs 30 are passed through the chosen apertures 26 and into the corresponding tubes 12, the tube plugs 30 then being tightened to compress the sealing means 62 between the facade plate 20 and the first surface 18 of the tube plate 14, so forming a sealing contact therebetween. Tubular inserts 60 are then passed through the remaining apertures 26, and into the corresponding tubes 12; an expander tool (not shown) is then passed into the tubular inserts 60, to expand their walls into contact with the expanded ends 28 of the tubes 12; the flanged ends 64 of the tubular inserts 60 are then further deformed until they contact the surface of the facade plate 20, to form a substantially fluid-tight seal between the tubular insert 60 and the facade plate 20. In an alternative embodiment, the expanding tool expands a part of the tubular insert 60 to contact the end 28 of the tube 12, and also expands another part of the tubular insert 60 to contact the facade aperture 26, prior to further deformation of the flange 64, thus ensuring a more extensive fluid-tight seal between the tubular insert 60 and the facade plate 20.

Whilst the embodiment described utilises a particular tube plug and tubular insert, in alternative embodiments any of the currently available designs of tube plug or tubular insert could be used. For example, the tubular insert described in my co-pending UK patent application 9216645.3 can be driven through the aperture into the corresponding tube, and provides the required sealing and engagement without need for there to be a subsequent expanding operation.

Figure 6:
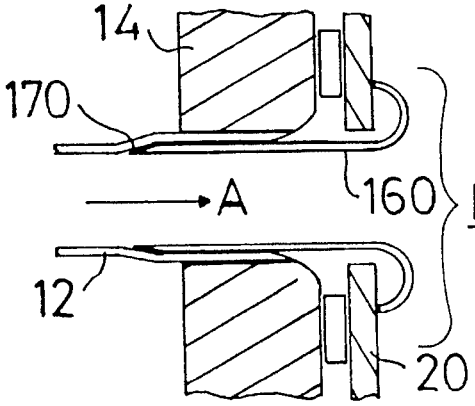
FIG. 6 is a part sectional view of a tube plate and facade plate fitted with an alternative embodiment of tubular insert.

In the alternative embodiment of FIG. 6, the tubular insert 160 is shortened, so as not to project beyond the expanded end 28 of tube 12. Tubular insert 160 has a bevelled leading edge 170, and is sized so that when expanded into the end 28 of the tube, it provides a substantially continuous internal surface to tube 12. Such a tubular insert will inhibit the formation of potentially damaging eddy currents adjacent the end of the tube 12, particularly for fluid flow in direction A. Whilst the facade plate would provide an extended life to an already eroded and/or corroded tube plate and tube, I foresee that many users of heat exchangers would require the fitment of my facade plate to new heat exchangers. Since, in use, the facade plate of the embodiment of the drawings, being within casing 15, is not subjected to the pressures of the fluid to be cooled and for which pressures the tube plate is designed, the facade plate would typically be only 2–5 mm in thickness, though preferably substantially non-flexible. The facade plate could be made of a material more corrosion and/or erosion resistant than the tube plate. If the facade plate is to be fitted to a new heat exchanger, the tube plate, which needs to be of thick section (i.e. between the first 18, and second 16, surfaces) to withstand the differential pressures involved, could be manufactured from a material of lesser corrosion and/or erosion resistance, so saving on cost, the facade plate being provided for the corrosion and erosion effects. In addition, the facade plate, secured as by the peripheral bolts in holes 24, by the tube plugs 30, and by the tubular inserts 60, all of which are removable, could and generally would itself be removable and thus replaceable, at a cost significantly lower than the cost of a complete overhaul of the tubes and tube plate, or the cost of a new heat exchanger.

In some heat exchanger installations, it may be commercially advantageous for the operator to replace all the heat exchanger tubes simultaneously with fitting a facade plate, but retaining (only) the original tube plates. If, as is likely, these original tube plates are eroded and/or corroded, the operator could fit longer tubes, so that they extend from the tube plate by the thickness of the facade plate (and seal).

Figure 5:
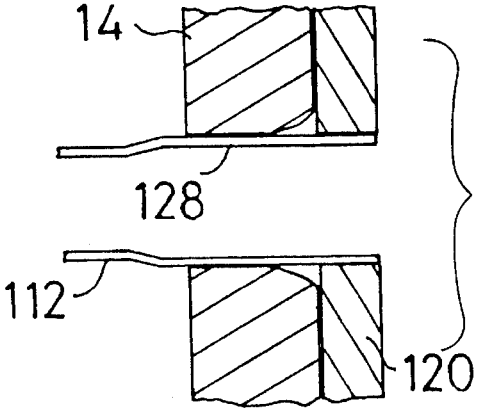
FIG. 5 is a part-sectional view of an alternative embodiment of a tube plate and fitted facade plate.

As shown in FIG. 5, such an extended tube 112 could then have its end 128 expanded into sealing contact with the wall of the respective aperture, as well as into contact with the uneroded portion of the tube plate opening. In this embodiment, facade plate 120 is substantially thick, but still not as thick as the tube plate 14. Whilst no sealing means in shown in the embodiment of FIG. 5, in alternative embodiments a sealing means may be fitted between the facade plate 120 and the tube plate 14. In a further alternative (though less preferred) embodiment, the end of the tubes are expanded into sealing contact only with the apertures in the facade plate.

Some larger heat exchangers, particularly those of rectangular section e.g. those with tube plates of 2 meters square or above, could utilise several facade plates, the respective facade plates each fitting to a different section of the tube plate. For example eight 1 m×0.5 m facade plates could be secured (as by suitably-located tube plugs) to a single 2 m square tube plate.

We have thus provided a simple and elegant solution to the problems of damaged heat exchangers, at a cost substantially less than the currently available methods. Thus the host, such as a cargo ship or cruise liner, may spend a minimum non-revenue earning time e.g. in dock, awaiting repair of the heat exchanger (perhaps also with the extra cost and delay of specialists brought in to assist the (ship's) engineers.

I claim:

1. A heat exchanger (10) which includes a tube plate (14) with preformed openings (17) extending between a first tube plate face (18) and a second tube plate face (16), a tube (12,112) connected to each said opening of the tube plate and projecting from said second tube plate face but not from said first tube plate face, a facade plate (20,120) having apertures (26) corresponding in relative position to at least some of the tube plate openings, and holding means to secure the facade plate to the first tube plate face with said apertures aligned with said openings, said holding means including a tubular insert having a tubular section with a part secured internally of a tube, another part extending through an aligned facade plate aperture, and a flange covering an area of the facade plate surrounding a respective aperture, the facade plate being substantially non-compressible whereby to limit the insertion of the tube insert into the tube.

2. A heat exchanger as claimed in claim 1, in which the tubular insert is in mechanical adhesion with at least one of the inner surface of a respective tube and a facade aperture (26).

3. A heat exchanger as claimed in claim 1, in which at least part of the tubular section of the tubular insert is expanded into contact with the tube, and in which the flange engages the facade plate.

4. A heat exchanger as claimed in claim 1, which said holding means also includes at least one of tube plate to header bolts at the outer periphery of the facade plate, and a holding member extending from the facade plate into a selected respective tube, said holding member being a tube plug adapted also to prevent fluid flow through the said selected tube.

5. A heat exchanger as claimed in claim 4, in which a tubular insert extends through an aperture in the facade plate and into a corresponding tube, for each aperture not occupied by a holding member.

6. A heat exchanger as claimed in claim 1, in which sealing means are located between the facade plate and the tube plate, said sealing means surrounding at least one aligned opening and aperture.

7. A heat exchanger as claimed in claim 6, in which a sealing sheet is affixed to the facade plate.

8. A heat exchanger as claimed in claim 1, in which the facade plate is thinner than the tube plate.

9. A facade plate (20,120) to be used in a heat exchanger as claimed in claim 1 and adapted for securement to at least a part of a heat exchanger tube plate (14), said facade plate having apertures (26) conforming to the openings (17) in the said part of the tube plate, and having sealing means (62) affixed thereto.

* * * * *